US005918666A

United States Patent [19]

Chin

[11] Patent Number: 5,918,666

[45] Date of Patent: Jul. 6, 1999

[54] INDOOR UNIT FOR AIR CONDITIONER

[75] Inventor: Sim Won Chin, Seoul, Rep. of Korea

[73] Assignee: LG Electronics, Inc., Rep. of Korea

[21] Appl. No.: 08/990,475

[22] Filed: Dec. 15, 1997

[30] Foreign Application Priority Data

Dec. 21, 1996 [KR] Rep. of Korea ..... 96-69440

[51] Int. Cl.[6] ..... F28F 13/12

[52] U.S. Cl. ..... 165/122; 165/121; 62/286; 415/53.1; 415/53.2

[58] Field of Search ..... 165/122, 135, 165/121, 123; 62/286, 285, 296; 415/119, 53.1, 53.2, 53.3

[56] References Cited

U.S. PATENT DOCUMENTS

| | | | |
|---|---|---|---|
| 5,094,586 | 3/1992 | Takada et al. | 415/53.3 |
| 5,211,219 | 5/1993 | Kawabata et al. | 165/122 |
| 5,388,426 | 2/1995 | Wada et al. | 165/122 X |
| 5,451,138 | 9/1995 | Istorik et al. | 415/53.1 |
| 5,573,059 | 11/1996 | Hamamoto et al. | 165/122 X |
| 5,647,431 | 7/1997 | Takeshita et al. | 165/122 X |
| 5,669,229 | 9/1997 | Ohbayashi et al. | 165/122 X |
| 5,673,747 | 10/1997 | Kousaka et al. | 165/122 X |

FOREIGN PATENT DOCUMENTS

| | | | |
|---|---|---|---|
| 0134435 | 8/1984 | Japan | 165/121 |
| 0129599 | 6/1987 | Japan | 415/53.1 |
| 0297947 | 12/1988 | Japan | 165/122 |

*Primary Examiner*—Christopher Atkinson
*Attorney, Agent, or Firm*—Ostrolenk, Faber, Gerb & Soffen, LLP

[57] ABSTRACT

An indoor unit for an air conditioner wherein a heat exchanger is tilted downward toward a rear guide in order to uniformly achieve an air inflow speed. A leading edge, a point from which the rear guide starts to curve, is located between an angle of 50 to 70 degrees counterclockwise from a horizontal line of the center of a cross flow fan. A drip pan is provided at an inner side of the lowermost grille and tilted downward in the direction of the rear guide for holding condensed fluid regardless of an installation location of the indoor unit.

3 Claims, 5 Drawing Sheets

INDOOR UNIT FOR AIR CONDITIONER

BACKGROUND OF THE INVENTION

1. Field of the Invention

The present invention relates to an air conditioner, and in particular to an improved indoor unit for an air conditioner, capable of stably exhausting air which is flows into grilles, and is easily fixed to a desirable location.

2. Description of the Conventional Art

Generally, an air conditioner refreshes indoor air by using cool and warm air generated in a heat exchanger. The air conditioner is divided into two types, one is a separate type in which an indoor unit and an outdoor unit are separated from each other, and the other is an unified type of which the indoor unit and the outdoor unit are a single unit.

FIG. 1 is a cross-sectional view of a conventional indoor unit for the air conditioner. As shown therein, in the indoor unit 10, a plurality of grilles 1 are installed in the front and upper parts thereof at predetermined intervals for inhaling air. In order to perform a heat exchange of the air flowing through the grilles 1 and to generate cooled or heated air currents, a heat exchanger 2 is installed inside the grilles 1. The heat exchanger 2 is incised into two parts, of which one part is positioned in the direction of the grilles 1 which are in the front part of the indoor unit 10, and the other part is installed in the vertical direction thereof. In addition, the indoor unit 10 includes a cross flow fan 3 for generating dynamic pressure by forming a vortex flow while rotating clockwise, a rear guide 4 for restoring the dynamic pressure to static pressure, and a stabilizer 7 for dividing a suction unit and an exhaust unit. Also, a drip pan 5 for holding condensed fluid generated from the heat exchanger 2, and a drain-hose (not shown) are positioned at the lower part of the heat exchanger 2.

The operation of the indoor unit 10 of the conventional air conditioner will be described.

When the cross flow fan 3 rotates and forms the vortex flow, the air flow, of which air is exchanged in the heat exchanger by the vortex flow, is flowed and becomes stable through the rear guide 4, thus being exhausted to an exhaust outlet 6 by the rear guide 4 and the stabilizer 7.

In order to stably exhaust the air current from the indoor unit to a room, the center of the vortex flow generated by the rotation of the cross flow fan 3 should be positioned in the vicinity of the exhaust outlet 6, thus stabilizing the flow by clearly dividing the suction and exhaust and reducing noises.

The rear guide 4 controls a location of the center of the vortex, and the location thereof is determined by a location of a leading edge L, that is a point from which the rear guide 4 starts to curve as well as a nearest point to the cross flow fan 3, thus settling stability of the whole flow and a noise level. The leading edge L from which the rear guide 4 starts to curve is located within an angle of 10 degrees and an angle of 40 degrees from a right horizontal line of the center of the cross flow fan 3.

However, the conventional indoor unit 10 of the air conditioner, wherein air is flowed through the grilles 1 installed in a suction intake and exhausted after the heat exchange is performed by the heat exchanger 2, is suitable for being fixed to a wall, but not to a ceiling or onto a floor due to its structural problems such as a drip pan location, locations of the suction intake and exhaust outlet, etc,. To make up for such problems of the indoor unit 10 as shown in FIG. 1, another indoor unit of the air conditioner was provided.

FIG. 2 is a cross-sectional view of another example of the conventional indoor unit 10 of the air conditioner. As shown therein, a plurality of grilles 1' are installed in a front part of the indoor unit 10' at certain intervals so that air can flow, and a heat exchanger 2' is installed inside the grilles 1'. The heat exchanger 2' is tilted downward towards a side of the grilles 1'. A cross flow fan 3' is positioned below the heat exchanger 2' to generate the dynamic pressure by which the air current, of which air is exchanged while passing through the heat exchanger 2', is whirled, and a rear guide 4' for restoring the dynamic pressure to the static pressure is positioned at the rear of the cross flow fan 3'.

In addition, a stabilizer 7' of a predetermined shape is installed in the front of the cross flow fan 3' in order to stabilize the air flowing into an exhaust outlet 6'.

A drip pan 5' is positioned right above the heat exchanger 2' in order to hold the condensed fluid generated from the heat exchanger 2' when the indoor unit 10' is fixed onto the floor, and a front wall 8 is provided above the stabilizer 7', attached to the grilles 1' as a single unit, to hold the condensed liquid in case where the indoor unit 10' is fixed to the ceiling.

A leading edge L' shows a point from which a curve of the rear guide 4' starts.

Since the operation of the thusly described indoor unit 10' of the air conditioner is identical to that of the indoor unit 10 as shown in FIG. 1, the description thereof will be omitted.

The conventional indoor unit 10' depicted in FIG. 2 is a convertible type, adequate for being fixed to a desirable location (the floor, ceiling, or wall), while the conventional indoor unit 10 depicted in FIG. 1 can only be fixed to the wall.

However, as shown in FIG. 2, the inflow speed of the air flowing into the heat exchanger 2' through the grilles 1' is not uniformly distributed, thus generates the noisy sounds.

Additionally, the leading edge L' of the rear guide 4', determining the location of the center of the vortex flow, is not positioned at an optimum location, thus the air flow becomes unstable.

SUMMARY OF THE INVENTION

Accordingly, it is an object of the present invention to provide an indoor unit for an air conditioner, capable of stably exhausting air flowing into grilles and suitable for being fixed to a desirable location.

To achieve the above objects, in a cross-flow-type indoor unit for an air conditioner wherein the heat of air flowing inwardly through a plurality of grilles is exchanged by a heat exchanger, and exhausted through an exhaust outlet, located between a stabilizer and a rear guide, by rotary power of a cross flow fan, there is provided an improved indoor unit for an air conditioner wherein the heat exchanger is tilted downward toward a rear guide in order to uniformly achieve an air inflow speed. A leading edge, a point from which the rear guide starts to curve, is located between an angle of 50 to 70 degrees counterclockwise from a horizontal line of the center of the cross flow fan, and a drip pan is provided at an inner side of the lowermost grille and tilted downward in the direction of the rear guide for holding condensed fluid regardless of an installation location of the indoor unit.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
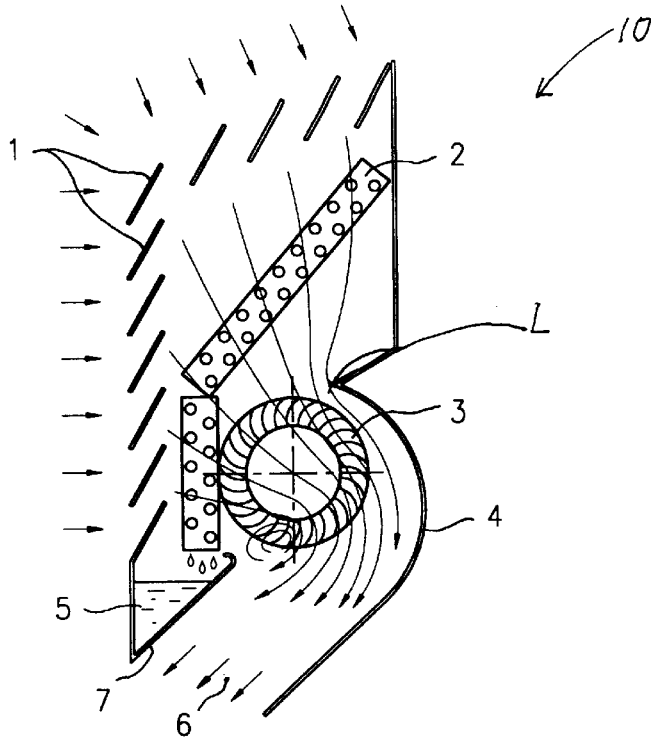
FIG. 1 CONVENTIONAL ART
FIG. 1 is a cross-sectional diagram illustrating an example of a conventional indoor unit for an air conditioner.
Figure 2:
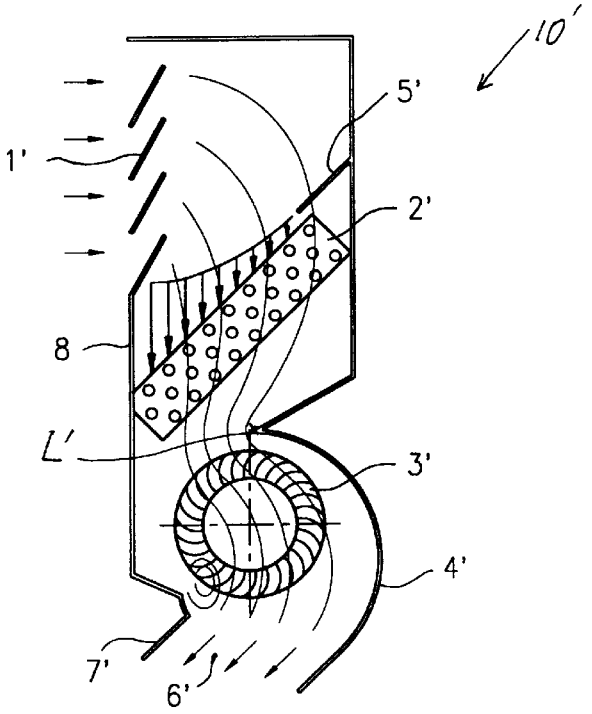
FIG. 2 CONVENTIONAL ART
FIG. 2 is a cross-sectional diagram illustrating another example of a conventional indoor unit for an air conditioner.
Figure 3:
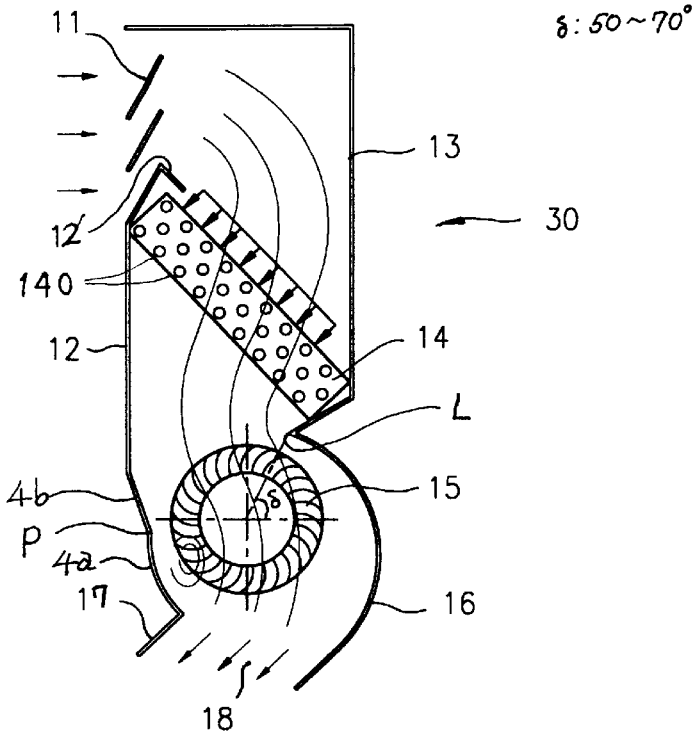
FIG. 3 is a cross-sectional diagram illustrating an indoor unit for an air conditioner according to the present invention.

FIG. 3 is a cross-sectional diagram illustrating an indoor unit for an air conditioner according to the present invention.

As shown therein, in the indoor unit 30, a plurality of grilles 11 are fixed at predetermined intervals so that air flows into a front upper part thereof, and a front wall 12 is vertically provided from the end part of the grilles 11.

A rear wall 13 is separately provided from the front wall 12 at a certain interval. Between the front wall 12 and rear wall 13, a heat exchanger 14 is fixed by being right-downward tilted in order to make uniform an inflow speed of air flowing from the grilles 11. A refrigerant passage tube 140 is disposed in heat exchanger 14 substantially paralled to the axis of rotation of a cross flow fan 15.

The cross flow fan 15 is fixed below the heat exchanger 14.

A block shaped rear guide 16 is provided at the rear of the cross flow fan 15 as a part of the rear wall 13 to restore static pressure from the dynamic pressure, and a stabilizer 17 is fixed in front of the cross flow fan 15 and at the end of the front wall 12 to stabilize air.

In addition, an exhaust outlet 18 is provided between the stabilizer 17 and rear guide 16.

On an upper part of the heat exchanger 14 at the front wall 12, a drip pan 12' is provided by being tilted downward in the direction of the heat exchanger 14 to hold condensed fluid from the heat exchanger 14.

In the cross-flow-type indoor unit for an air conditioner according to the present invention, a location of a suction intake is upward provided, thus an adequate flow path should be provided in order that the flow path of flowed air may be changed and an air current may stably be exhausted. Also, to find out the adequate flow path, it should be provided the optimum location of a leading edge L which changes a center location of the vortex generated by the operation of the cross flow fan 15.

Figure 4A:
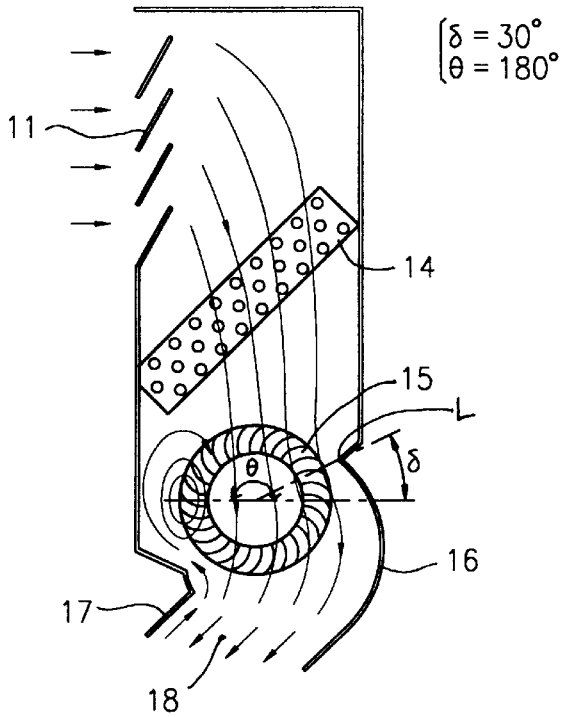
FIG. 4A is a cross-sectional diagram illustrating an air inflow state of an indoor unit according to the present invention when a leading edge is located in the vicinity of an angle of 30 degrees counterclockwise from a right horizontal line of the center of the cross flow fan.
Figure 4B:
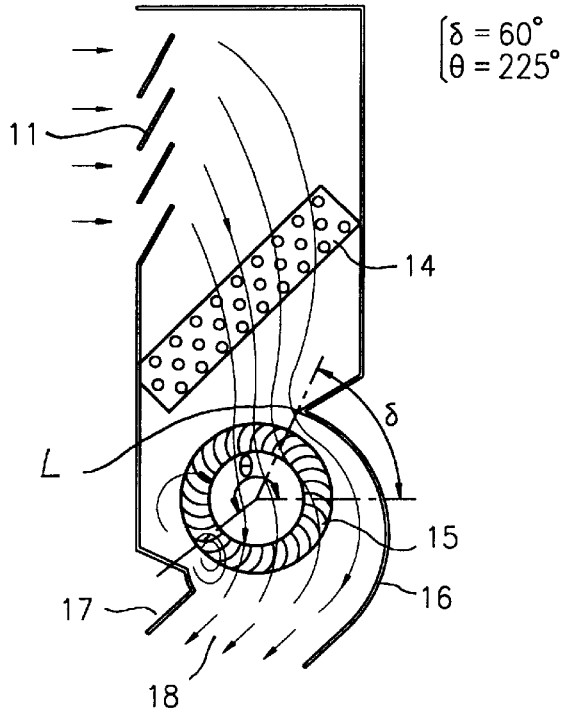
FIG. 4B is a cross-sectional diagram illustrating an air inflow state of an indoor unit according to the present invention when a leading edge is located in the vicinity of an angle of 60 degrees counterclockwise from a right horizontal line of the center of the cross flow fan.
Figure 4C:
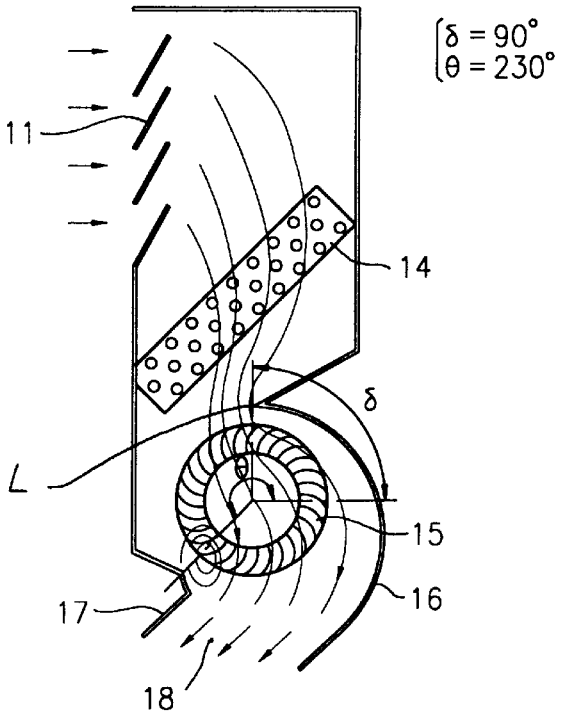
FIG. 4C is a cross-sectional diagram illustrating an air inflow state of an indoor unit according to the present invention when a leading edge is located in the vicinity of an angle of 90 degrees counterclockwise from a right horizontal line of the center of the cross flow fan.

FIGS. 4A to 4C illustrate various a location of the leading edge L formed at the rear guide 16.

As shown in FIG. 4A, when a leading edge L is located in the vicinity of an angle of 30 degrees counterclockwise from a right horizontal line of the center of the cross flow fan 15, the center of the vortex flow is formed around an angle of 180 degrees; and an upstream current is generated so that air flows from the exhaust outlet 18 and thus a noisy sound is irregularly produced.

As shown in 4B, when the leading edge L is located in the vicinity of an angle of 60 degrees counterclockwise from the right horizontal line of the center of the cross flow fan 15, the center of the vortex flow is formed around an angle of 225 degrees, and thus the air suction and exhaust flow becomes stabilized with a certain direction, and the noise is remarkably decreased and becomes regular.

As shown in 4C, when the leading edge L is located in the vicinity of an angle of 90 degrees counterclockwise from the right horizontal line of the center of the cross flow fan 15, the center of the vortex flow is formed around an angle of 230 degrees, and thus the air suction and exhaust flow becomes stabilized with a certain direction, however the noise is decreased less as compared to the leading edge L as shown in FIG. 4B. As described above, when the leading edge L is located between an angle of 50 degrees and an angle of 70 degrees counterclockwise from a right horizontal line of the center of the cross flow fan 15, the exhaust air current becomes stabilized and the noise produced is kept to a minimum.

As seen in FIG. 3, the stabilizer 17 is provided with a curved surface portion 4*a* and a straight line surface portion 4*b* centering around a curve start point P, thereby stabilizing the center of the vortex flow formed by the operation of the cross flow fan 15, and therefore leading to the stable air suction and exhaust and a uniform generation of noise.

Accordingly, it is desirable for the leading edge L from which the rear guide 16 starts to curve to be located in a range between the angle of 50 degrees and the angle of 70 degrees counterclockwise from a right horizontal line of the center of the cross flow fan 15 in order that the center of the vortex flow generated by the rotation of the cross flow fan 15 may be located around the exhaust outlet 18.

With reference to the accompanying drawing, the operation of the indoor of the air conditioner according to the present invention will be described in detail.

First, when the cross flow fan 15 rotates, air flows inward through the grilles 11 by the rotary power thereof. The air passes through the heat exchanger 14 with an uniform distribution of the air inflow speed, thus accomplishing the heat exchange. Then, the heat-exchanged air is changed to the vortex having dynamic pressure by passing through the cross flow fan 15.

While flowing between the rear guide 16 and stabilizer 17, the air having dynamic pressure is restored to static pressure and exhausted through the exhaust outlet 18.

Since the leading edge L, the point from which the rear guide 16 starts to curve, is located in a range between the angle of 50 degrees and the angle of 70 degrees counterclockwise from the right horizontal line of the center of the cross flow fan 15, the center of the vortex flow generated by the rotation of the cross flow fan 15 is located around the vicinity of the exhaust outlet 18.

In other words, when the leading edge L is located in the range between the angle of 50 degrees and the angle of 70 degrees anticlockwise from the right horizontal line of the center of the cross flow fan 15, the air flow is in the most stable condition.

In addition, the straight line surface portion 4*b* is provided at an upper part of the curve start point P, which is the nearest point to the cross flow fan 15, and the curved surface portion 4*a* is provided at a lower part of the curve start point P, whereby the recessed curved surface portion 4*a* stabilizes the location of the vortex flow, thus eliminating the noise which is irregularly produced.

Where the indoor unit 30 of the air conditioner according to the present invention is fixed to a desirable position, a location wherein the condensed fluid from the heat exchanger 14 is collected will be described with respect to each installation location.

Figure 5A:
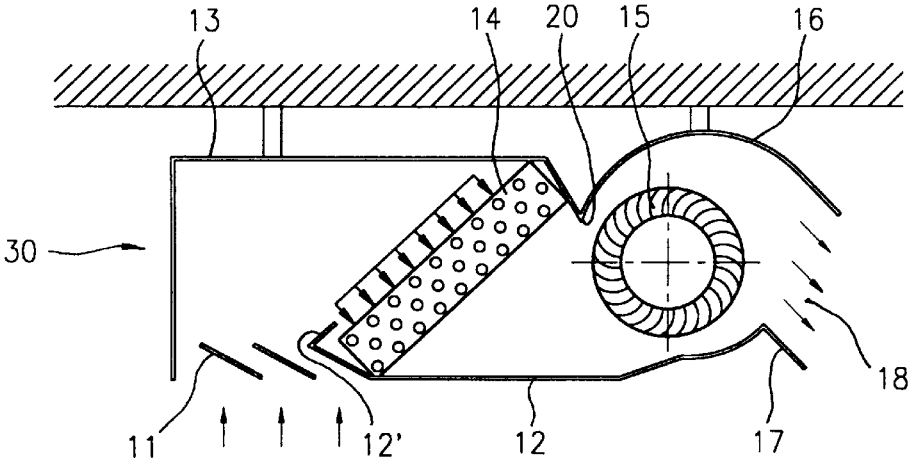
FIG. 5A is a cross-sectional diagram illustrating an indoor unit according to the present invention being fixed to a ceiling.

FIG. 5A is a cross-sectional diagram illustrating an indoor unit according to the present invention being fixed to a ceiling. As shown therein, when the indoor unit 30 is fixed to the ceiling, the condensed fluid is contained by the front wall 12 and drip pan 12' because the front wall 12 is downwards located. That is, the front wall 12 serves as a part of the drip pan 12'.

Figure 5B:
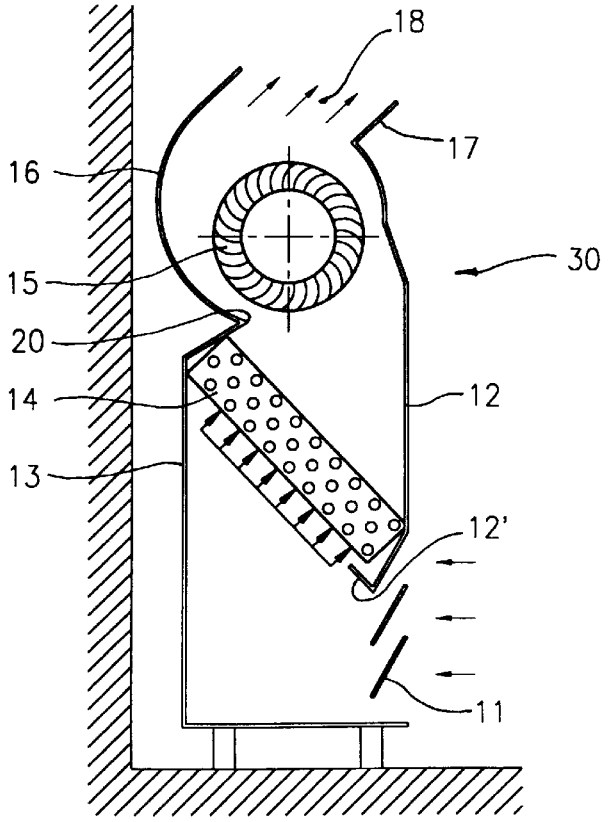
FIG. 5B is a cross-sectional diagram illustrating an indoor unit according to the present invention being fixed onto a floor.
Figure 5C:
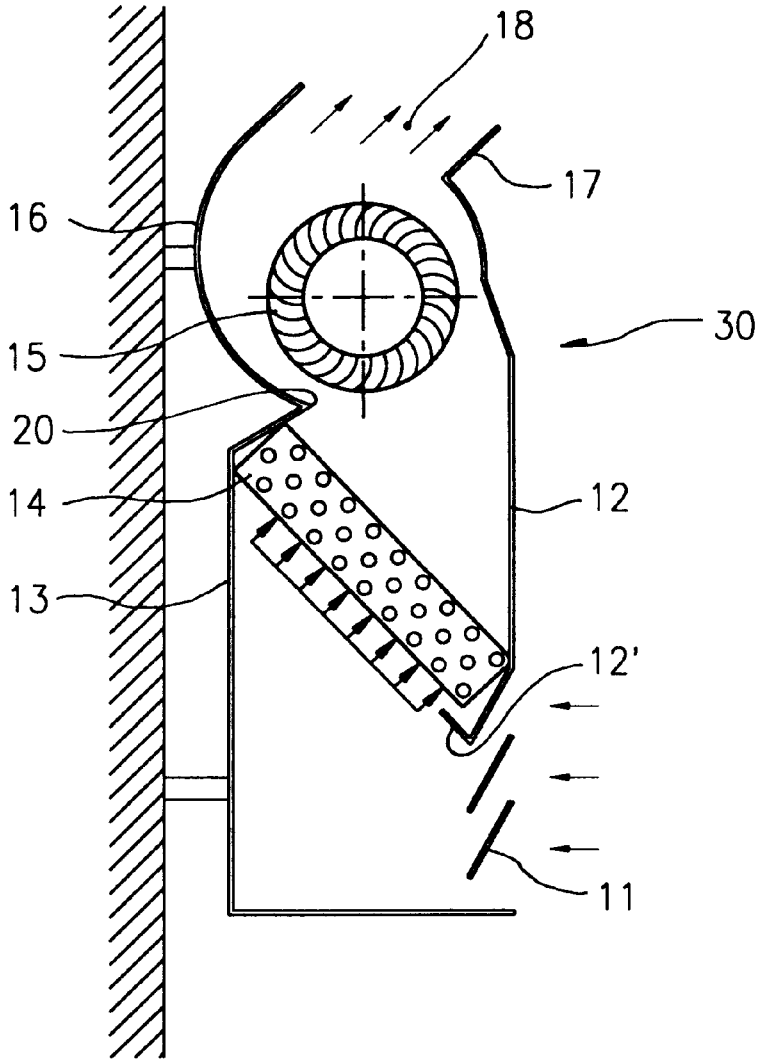
FIG. 5C is a cross-sectional diagram illustrating an indoor unit according to the present invention being fixed to a wall.

FIG. 5B is a cross-sectional diagram illustrating an indoor unit according to the present invention being fixed onto a floor, and FIG. 5C is a cross-sectional diagram illustrating an indoor unit according to the present invention being fixed to a wall. As shown therein, when the indoor unit 30 is fixed onto the floor or the wall, the condensed fluid, flowing along the heat exchanger 14, is held into a space of the grill 11 and drip pan 12'.

As described above, by fixing the heat exchanger in order to make uniform the inflow speed of air and by locating the leading edge in the range between the angle of 50 degrees and the angle of 70 degrees counterclockwise from the right horizontal line of the center of the cross flow fan, the air flow is stabilized, thus decreasing the noise of the indoor unit and improving the product efficiency.

In addition, since condensed fluid is collected with only a single drip pan, regardless of an installation location of the indoor unit, the indoor unit according to the present invention is capable of cutting the manufacturing cost and improving the productivity.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. In an indoor unit for an air conditioner having an upper part, a lower part, a front wall, a cross flow fan disposed in the lower part, a heat exchanger, a rear guide, and a stabilizer, and wherein an air suction intake is provided only at the upper part of the indoor unit above the cross flow fan, an improvement comprising:

a leading edge, from which the rear guide starts to curve, is formed in a range between an angle of 50 degrees and angle of 70 degrees from a line substantially perpendicular to the front wall of the indoor unit through a center of the cross flow fan; and centering around a curve start point, that is the nearest point to the cross flow fan, the stabilizer is provided with a curved surface portion on the lower part thereof and a straight line surface portion on the upper part thereof.

2. In an indoor unit for an air conditioner having a planar heat exchanger, a rear guide, and a stabilizer, the indoor unit having an upper part, a lower part and a front wall, and wherein an air suction intake is provided only at the upper part of the indoor unit, an improvement comprising:

one side of the heat exchanger, positioned at a side of the air suction intake, is located higher than the other side thereof, and a refrigerant passage tube of the heat exchanger is disposed substantially parallel to an axis of rotation of the cross flow fan.

3. The unit of claim 2, wherein a drip pan is provided at an upper side end part of the heat exchanger.

* * * * *